United States Patent [19]

Yamada et al.

[11] Patent Number: 4,743,505

[45] Date of Patent: May 10, 1988

[54] ELECTROCONDUCTIVE COMPOSITE FIBER AND PROCESS FOR PREPARATION THEREOF

[75] Inventors: Setsuo Yamada, Ashiya; Fumiki Takabayashi; Yoshiyuki Sasaki, both of Takatsuki; Katsuyuki Kasaoka, Ibaraki, all of Japan

[73] Assignee: Teijin Limited, Osaka, Japan

[21] Appl. No.: 895,791

[22] Filed: Aug. 12, 1986

[30] Foreign Application Priority Data

Aug. 27, 1985 [JP] Japan ..... 60-186595
Apr. 18, 1986 [JP] Japan ..... 61-88180

[51] Int. Cl.[4] ..... D02G 3/00

[52] U.S. Cl. ..... 428/373; 428/372; 428/375; 428/378; 428/379; 428/392; 428/394; 428/395; 428/400

[58] Field of Search ..... 428/372, 373, 375, 400, 428/383, 379, 394, 395, 392, 378

[56] References Cited

U.S. PATENT DOCUMENTS

| | | | |
|---|---|---|---|
| 3,944,709 | 3/1976 | Levy | 427/40 |
| 3,958,066 | 5/1976 | Imamura et al. | 428/372 |
| 4,129,677 | 12/1978 | Boe | 428/372 |
| 4,188,426 | 2/1980 | Auerbach | 427/41 |
| 4,216,264 | 8/1980 | Naruse et al. | 428/372 |
| 4,267,233 | 5/1981 | Tanaka et al. | 428/395 |
| 4,309,479 | 1/1982 | Naruse et al. | 428/372 |
| 4,344,981 | 8/1982 | Imada et al. | 427/41 |
| 4,420,534 | 12/1983 | Matsui et al. | 428/372 |

FOREIGN PATENT DOCUMENTS

| | | | |
|---|---|---|---|
| 161126 | 10/1982 | Japan | 428/379 |
| 47474 | 3/1984 | Japan | 428/372 |
| 110920 | 6/1985 | Japan . | |

*Primary Examiner*—Lorraine T. Kendell
*Assistant Examiner*—S. A. Gibson
*Attorney, Agent, or Firm*—Burgess, Ryan & Wayne

[57] ABSTRACT

An electroconductive core-sheath composite fiber comprising a core containing an electroconductive substance and a sheath formed of a fiber-forming polymer, which surrounds the core, wherein the core is completely covered with the sheath, the electric resistance of the surface of the fiber is lower than $10^{10}$ Ω/cm, and the ratio of the electric resistance (Ω/cm) of the surface to the internal electric resistance between the sections is lower than $10^3$.

16 Claims, 2 Drawing Sheets

ELECTROCONDUCTIVE COMPOSITE FIBER AND PROCESS FOR PREPARATION THEREOF

BACKGROUND OF THE INVENTION (1) Field of the Invention

The present invention relates to an electroconductive composite fiber and a process for the preparation thereof.

(2) Description of the Related Art

Thermoplastic resins such as polyethylene, polyamides and polyesters are used as fibrous products in various fields. However, fibrous products of these thermoplastic resins are defective in that the antistatic property is poor and they are easily chargeable. Troubles caused by static electricity have been discussed, and recently, the problem of static electricity has been particularly commented on. The reason is that recent advance of research on static electricity has revealed that many troubles which have been considered to arise from unknown causes, such as fires and explosions, are due to static electricity and troubles caused by static electricity increase in semiconductors and computers comprising semiconductors.

Increase of such troubles is due to the fact that materials that are easily charged, for example, synthetic fibers and plastics, are increasing around us, because of development of air-conditioning systems, the environmental humidity is reduced and operations are often conducted under a low humidity where static electricity is readily generated, and recently developed OA devices are readily damaged by static electricity. For example, since a cloth formed of polyethylene terephthalate fibers is statically charged during wearing to twine and tangle around the body and render walking difficult. Furthermore, such a cloth absorbs dusts floating in air and becomes dirty, and in case of a dust-free garment, mesh clogging is readily caused. Moreover, a discharge shock is generated when a person walking on a carpet touches a handle of a door, and in this case, if a combustible liquid or gas is present in the vicinity, there is a risk of a fire or explosion. As means for solving these problems, various methods using electroconductive fibers have been proposed.

According to the first method, an electroconductive substance is coated on the surface of a fiber. More specifically, a metal-plated fiber formed by chemically plating a metal on a fiber and an electro-conductive fiber formed by coating an electroconductive powder such as a metal powder or carbon black on the surface of a fiber have been proposed. In these electroconductive fibers, the electroconductivity is good at the initial stage, but the abrasion resistance during wearing is poor, and the electroconductive layer present on the surface is peeled by washing and the electroconductivity is accordingly drastically reduced. Furthermore, the chemical resistance is poor and when the fiber of this type is used for a dustfree garment, the garment becomes a dust-forming source.

According to the second method, a composite fiber is prepared by forming a sheath layer of a fiber-forming copolymer around a core of a thermoplastic resin having a powder of an electroconductive substance dispersed therein. In case of an electroconductive composite fiber having electroconductive carbon incorporated therein, since carbon is black, if the sheath layer is thin, the fiber is seen black and cannot be used in the field where an aesthetic effect is important. As means for obviating this disadvantage, there can be mentioned a method in which the amount of titanium oxide in the sheath polymer is greatly increased and incident and refracted light in the sheath polymer is reflected on the surface of titanium oxide, whereby the hue is improved to a grey level. In order for titanium oxide to sufficiently exert an effect of hiding carbon black, a certain distance should be present between the surface of the sheath layer and the core and the core should be present substantially at the center of the section.

Even in the case where a sheath-core composite fiber is formed by using a white electroconductive metal compound such as stannic oxide, if the core is not completely covered by the sheath layer, the electro-conductive agent present in the core is decomposed especially by oxidation-reduction chemicals, resulting in occurrence of troubles such as reduction of the electroconductivity and reduction of the performance by falling during wearing. However, if complete covering is attained by the sheath layer, the following electric problem arises.

Although the electroconductivity is good between the sections, since the sheath layer is formed of a polymer having a good fiber-forming property and is electrically insulating, the electric resistance of the surface is high and the electroconductivity of the surface is insufficient.

Accordingly, even in a fabric composed of such a sheath-core type composite fiber containing an electroconductive substance in the core, static electricity is accumulated and the electricity-removing function based on corona discharge by the electroconductive fiber is not properly exerted, but such troubles as twining of a cloth around the body, generation of cracking discharge sounds and adhesion of dusts arise and there is still present a risk of a fire or explosion by static electricity. As means for solving these problems involved in sheath-core composite fibers, Japanese Unexamined Patent Publication No. 60-110920 proposes a method in which the core is eccentrically arranged and the thickness of the sheath layer is controlled below 3 μm. However, this method is defective in that spinning is very difficult, the electric resistance cannot be reduced to a desirable level and deviation of the electroconductivity is large.

SUMMARY OF THE INVENTION

It is a primary object of the present invention to solve the foregoing problems and provide a novel electroconductive fiber. This conductive fiber is a complete sheath-core fiber in which since the electroconductive substance contained in the core has a coloration-preventing effect and is chemical-resistant and abrasion-resistant, even if the electroconductive substance is not exposed to the surface at all, the electric resistance of the surface of the electroconductive fiber can be maintained at a very low level.

Another object of the present invention is to provide a process for the preparation of an electroconductive composite fiber as mentioned above.

In accordance with one aspect of the present invention, there is provided a sheath-core composite fiber comprising a core containing an electroconductive substance and a sheath formed of a fiber-forming polymer, which surrounds the core, wherein the core is completely covered with the sheath, the electric resistance of the surface of the fiber is lower than $10^{10}$ Ω/cm, and the ratio of the electric resistance (Ω/cm) of the surface of the fiber to the internal electric resistance (Ω/cm) between the sections of the fiber is lower than $10^3$.

This electroconductive composite fiber can be prepared by subjecting a sheath-core composite fiber comprising a core containing an electroconductive substance and a sheath formed of a fiber-forming polymer, which surrounds the core, to a discharge treatment between high-voltage electrodes.

DESCRIPTION OF THE PREFERRED EMBODIMENTS

Figure 1:
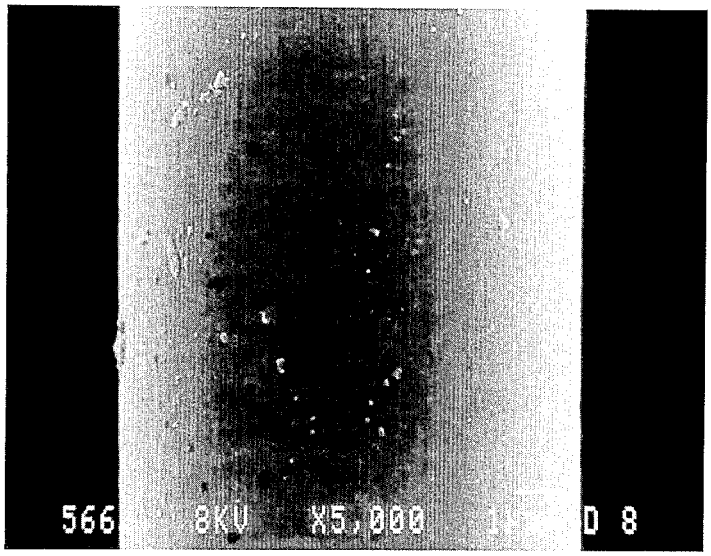
FIG. 1 is a microscope photo showing the state of discharge marks present on the surface of a composite fiber according to an embodiment of the present invention.

The present invention relates to a core-sheath composite fiber having a core-sheath structure comprising a core containing an electroconductive substance and a sheath formed of an organic polymeric compound, wherein the core is completely covered with the sheath, discharge marks by a high-voltage discharge treatment are scattered along the direction of the fiber axis on the surface of the composite fiber, and at least one discharge mark is present per 1 mm of the length in the direction of the fiber axis.

The core constituting the composite fiber of the present invention contains an electroconductive substance. A known electroconductive substance can be used. For example, there can be mentioned electroconductive carbon black, a metal, an electroconductive metal compound and an electroconductive non-metallic compound.

As the carbon black, there can be mentioned oil furnace black, acetylene black, thermal black, ketchen black and channel black.

As the metal, there can be mentioned copper, iron, aluminum and nickel.

As the electroconductive metal compound, there can be mentioned a composition comprising a metal oxide as a main component and a minute or small amount of a metal oxide different from the main metal oxide in the atomic valency or ion radius. Specific examples are shown in Table 1.

TABLE 1

| Metal Oxide | Additive |
|---|---|
| nickel oxide (NiO) | lithium oxide ($Li_2O$) |
| cobalt oxide | " |
| iron monoxide (FeO) | " |
| manganese oxide (MnO) | " |
| zinc oxide | aluminum oxide ($Al_2O_3$) |
| titanium oxide ($TiO_2$) | tantalum oxide ($Ta_2O_3$) |
| bismuth oxide ($Bi_2O_3$) | barium oxide (BaO) |
| iron oxide ($Fe_2O_3$) | titanium oxide ($TiO_2$) |
| titanium barium oxide ($BaTiO_3$) | lanthanum oxide ($La_2O_3$) |
| " | tantalum oxide ($Ta_2O_5$) |
| chromium lanthanum oxide ($LaCrO_3$) | strontium oxide (SrO) |
| magnesium lanthanum oxide ($LaMnO_3$) | " |
| $K_2O$—$11Fe_2O_3$ | titanium oxide ($TiO_2$) |
| chromium oxide | magnesium oxide |

As the electroconductive metal non-oxide compound, there can be mentioned titanium carbide (TiC), tantalum carbide (TaC) and niobium carbide (NbC).

As the electroconductive metal nitride, there can be mentioned titanium nitride (TiN), tantalum nitride (TaN), zirconium nitride (ZrN), hafnium nitride (HfN), vanadium nitride (VN, $V_3N$) and tungsten nitride (WN). Furthermore, there can be mentioned electroconductive metal halides (such as copper iodide), electroconductive metal sulfides (such as copper sulfide) and electroconductive borides (such as manganese boride and beryllium boride). Composites or mixtures of two or more of the foregoing conducting agents can be used as the electroconductive substance of the core. For example, titanium black in which crystals of titanium monoxide (TiO) and titanium nitride (TiN) are so-present.

These electroconductive substances are ordinarily handled in the form of fine powders, but the crystal form is not limited to a circle, plate or scale. Furthermore, an electroconductive metal composite formed by coating such an electroconductive compound, for example, fine particulate titanium oxide, can be used.

The electroconductive substance is used in combination with a low-temperature flowing substance. As the low-temperature flowing substance, there are preferably used polyethylene, polypropylene, polystyrene, polybutadiene, polyisoprene, nylon-6, nylon-6,6, polyethylene terephthalate and polybutylene terephthalate. A part of the polymer may be substituted with a comonomer component. Other resin may be used as the low-temperature flowing substance according to need, or two or more of these low-temperature flowing substances may be used in combination.

An oleophilic agent for the electroconductive substance can be used according to need. An organic carboxylic acid having at least 6 carbon atoms and an organic sulfonic acid having at least 5 carbon atoms are preferred. As the organic group bonded to the carboxylic or sulfonic group, alkyl groups, alkylene groups, aryl groups, alkylaryl groups and aralkyl groups are preferred. These groups may have optional substituents other than carboxylic acid sulfonic groups.

As specific examples of the organic carboxylic acid, n-caproic acid, benzoic acid, n-caprylic acid, phenylacetic acid, toluic acid, n-nonanoic acid, n-capric acid and stearic acid. As the organic sulfonic acid, there can be mentioned n-pentane-sulfonic acid, benzenesulfonic acid and dodecylbenzene-sulfonic acid. These organic carboxylic acids and organic sulfonic acids as the olephilic agent can be used singly or in the form of mixtures of two or more of them.

The sheath surrounding the core is formed of a fiber-forming polymer which is an organic polymeric compound. As the fiber-forming polymer, there can be mentioned, for example, polyesters, nylon-6, nylon-6,6 and polypropylene. Among polyesters, polyethylene terephthalate is preferred because it has a good touch, is excellent in the handling property at the processing step and has a good chemical resistance.

The composite fiber comprising a sheath formed of a fiber-forming polymer as described above has a high surface resistance and is insufficient in the electroconductivity, even if the core containing the electroconductive substance has an electroconductivity, and therefore, the composite fiber is easily chargeable.

The fiber of the present invention is obtained by subjecting this composite fiber to a discharge treatment as described hereinafter. It is important that after this discharge treatment, the electric resistance of the fiber should be lower than $10^{10}$ Ω/cm and the ratio of the electric resistance (Ω/cm) of the surface of the fiber to the internal electric resistance (Ω/cm) between the sections of the fiber is lower than $10^3$.

Ordinarily, the surface of a fiber composed of a fiber-forming polymer is very high and in an order of $10^{13}$ Ω/cm, and even if the internal electric resistance between the sections is low and in an order of $10^7$ Ω/cm, the ratio of the surface electric resistance to the internal electric resistance between the sections is high and about $10^6$ and no substantial electroconductive effect is manifested on the surface of the fiber.

In contrast, in the fiber of the present invention, the surface electric resistance is low and below an order of $10^{10}$ Ω/cm, even though the fiber is composed of a fiber-forming polymer.

In the composite fiber of the present invention, the core is completely covered with the sheath, and it is preferred that discharge marks by a high-voltage discharge treatment be scattered along the direction of the fiber axis on the surface formed of the sheath.

FIG. 1 is a microscope photograph showing the state of discharge marks scattered on the surface of a composite fiber according to an embodiment of the present invention.

Figure 2:
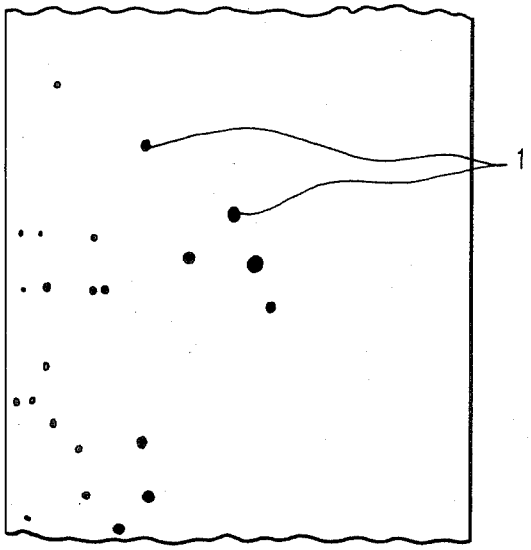
FIG. 2 is a side view showing the positions of the discharge marks in the photograph of FIG. 1.

FIG. 2 is a side view showing the positions of discharge marks 1 in FIG. 1.

The discharge marks 1 are scattered like specks along the direction of the fiber axis. The discharge marks need not be distributed at all the points along the circumference of the surface, but they may be distributed preferentially on one side face. It is preferred that the discharge marks be scattered continuously along the direction of the fiber axis or along the surface of the fabric.

The discharge marks 1 scattered as shown in FIGS. 1 and 2 may have a diameter smaller than 2 microns and they are substantially black. It is considered that the discharge marks are formed by complete or partial carbonization at the discharge treatment. It is preferred that at least one discharge mark, especially at least 5 discharge marks, be present per mm of the length in the direction of the fiber axis. If the number of discharge marks is smaller than 1 per mm of the length in the direction of the fiber axis, no sufficient antistatic effect can be obtained.

The discharge treatment will now be described.

According to the present invention, the so-obtained core-sheath composite fiber is treated by a high-voltage discharge treatment method such as an electricity-applying method in which the fiber is brought into contact with a high-voltage electrode to apply a high voltage to the fiber or a corona discharge, spark discharge, glow discharge or arc discharge method in which discharge shapes are different.

A high voltage of 1 to 100 KV may be adopted as the applied voltage, and it is preferred that the applied voltage be 5 to 100 KV, especially 10 to 50 KV. The polarity of the voltage may be positive or negative, and either an alternating current voltage or a direct current voltage may be applied. The distance between electrodes may be 0 to 10 cm, and the electrode distance is determined relatively to the discharge state and the treating speed. As the optimum method, there can be mentioned a method in which the core containing the electroconductive substance is used as one electrode, another electrode is disposed, a high voltage is applied between the two electrodes and the discharge treatment is effected under a high electrode voltage. However, applicable methods are not limited to this method, but there can be adopted a method in which a high voltage is applied between separately disposed electrodes.

This discharge treatment may be conducted on a yarn, a knitted or woven fabric or a non-woven fabric. The yarn may be a drawn yarn or an undrawn yarn.

Preferably, the core-sheath composite fiber may be treated or applied with an aqueous liquid before the discharge treatment. As the method for applying the aqueous liquid, there may be mentioned methods in which the composite fiber is dipped into the aqueous liquid or the aqueous liquid is sprayed onto the fiber. As the aqueous liquid, there may be mentioned those consisting of water alone and containing a surfactant or electrolyte. The examples of the surfactant include polyalkylene glycol, sodium alkylsulfonates, sodium trialkylphosphates and sodium alkylcalboxylates. The electrolyte may mainly include inorganic salts, such as sodium sulfate, sodium nitrate and potassium chloride.

Where the core-sheath composite fiber is subjected to the discharge treatment after being applied with water as mentioned above, the degree of distribution of the discharge density is improved and the discharge marks are relatively uniformly distributed on the fiber surface. As the results, there can be obtained a surface electric resistance close to the internal electric resistance between the sections and the surface electroconductivity can be improved.

When the composite fiber is subjected to the discharge treatment, there are observed three stages according to the discharge intensity. At the initial stage of discharge, charges are injected into the surface of the sheath which is an insulator and the surface is permanently charged. That is, so called microelectrets are formed. However, the electric resistance of the surface of the fiber is higher than an order of $10^{11}$ Ω/cm and the ratio of the surface electric resistance to the internal electric resistance between the sections is higher than $10^4$. Accordingly, an intended electroconductive fiber cannot be obtained.

However, if the discharge intensity is excessively increased, abnormal discharge with red flames is caused or oxidation is promoted on the surface of the metal electrode, resulting in uneven discharge. Accordingly, the discharge energy is converted to heat on the surface of the fiber and the fiber is fused and cut. Furthermore, partial melting is sometimes observed, and the physical properties, especially the strength and elongation, of the fiber are drastically reduced. Also in this case, an intended electroconductive fiber cannot be obtained.

In the state where an arc generated by the discharge treatment is blue and discontinuous, the state is the above-mentioned electret state or it is impossible to scatter discharge marks along the direction of the axis of the fiber. As the discharge intensity is increased, abnormal discharge is caused. Accordingly, the discharge intensity is adjusted to a level just below the discharge intensity causing abnormal discharge, and the distance between the electrodes, the voltage and the treatment atmosphere are adjusted so that a blue arc is continuously formed. Thus, discharge marks can be scattered along the direction of the axis of the fiber, as intended in the present invention.

By this discharge treatment, the electric resistance of the surface can be reduced below an order of $10^{10}$ Ω/cm, and the ratio of the electric resistance of the surface to the internal electric resistance between the sections can be reduced below $10^3$, preferably below $10^2$, and especially preferably below 10 when the composite fiber is used under severe conditions.

The value of this ratio can be adjusted by controlling the time of the discharge treatment and the applied voltage.

The discharge marks on the surface of the fiber depends on the discharge intensity, and the discharge intensity depends on the voltage, the electrode distance, the electrode shape and the state of the surface of the fiber. According to a preferred embodiment of the present invention, the discharge marks have a diameter smaller than 2 microns and the number of the discharge marks is at least 1 per mm of the length in the direction of the fiber axis. In this embodiment, an excellent electroconductivity can be obtained and drastic reduction of the strength can be prevented.

In the case where the discharge intensity is too low, the electric resistance of the surface of the fiber cannot be reduced and no good electroconductivity can be obtained. On the other hand, if the discharge intensity is too high, the strength is drastically reduced with reduction of the electric resistance of the surface of the fiber, and the fiber cannot resist various treatments at the knitting or weaving operation. By the excessive discharge treatment causing reduction of the strength to a level not resisting the processing, speck-like discharge marks as formed in the present invention are not formed, but discharge marks are fused and the diameter exceeds 2 microns. If the discharge marks are as specified in the present invention, a good antistatic property can be obtained and reduction of the strength can be controlled to a very low level.

In the fiber of the present invention, the ratio of the electric resistance of the surface of the fiber to the internal electric resistance between the sections (in order to pass electricity through the core containing the electroconductive substance, this internal electric resistance is substantially equal to the electric resistance of the core and is lower than an order of $10^8$ Ω/cm, preferably lower than $10^7$ Ω/cm) is lower than $10^3$, and the surface electric resistance is lower than an order of $10^{10}$ Ω/cm. The reason is that the electric resistance of the fiber-forming polymer is reduced by the high-voltage discharge treatment.

A fiber composed of a fiber-forming polymer has ordinarily an electric resistance of about $10^{13}$ Ω/cm, and this high electric resistance causes troubles owing to charging. For example, even in the case where the electric resistance of the core containing the electroconductive substance is low and in an order of $10^7$ Ω/cm, if the electric resistance of the fiber-forming polymer surrounding the core is high as mentioned above, no sufficient antistatic effect can be obtained.

Accordingly, in a conventional core-sheath composite fiber of this type, it is necessary to make such a contrivance that a part of the core containing an electroconductive substance is exposed to a part of the surface of the fiber or the position of the core in the section of the fiber is made drastically eccentric.

In the present invention, the surface electric resistance of the fiber-forming polymer as the sheath can be controlled to a level lower than an order of $10^{10}$ Ω/cm, or if necessary to a level lower than an order of $10^9$ Ω/cm, especially an order of $10^8$ Ω/cm, and this surface electric resistance can be reduced to a level substantially equal to the electric resistance of the core, if required. Accordingly, occurrence of troubles by static electricity can be prevented.

This low electric resistance can be obtained by subjecting a core-sheath composite fiber comprising a core containing an electroconductive substance and a sheath formed of a fiber-forming polymer, which surrounds the core, to a high-voltage discharge treatment. Especially when the core of this composite fiber is used as one electrode while another electrode is independently formed and a high voltage is applied between the electrodes to effect a discharge treatment, the electrically insulating property of the fiber-forming property is removed and an electric property resembling that of a semiconductor can be imparted.

Furthermore, in the present invention, since the electroconductive core (causing various troubles) exerts an antistatic effect even though the core is completely covered with the sheath, the problem of coloration or falling during the use can be avoided. Especially, it is not necessary to adjust the distance between the core and the fiber surface to less than 3 μm, and spinning can be performed very easily. In the composite fiber of the present invention having such complete sheath-core structure, a sufficient antistatic effect can be attained. This is an epoch-making functional effect of the present invention, which has not been attained by any conventional technique.

In the instant specification and appended claims, the electric resistance (Ω/cm), the number of discharge marks and the antistatic property are those determined according to the following methods.

Internal Electric Resistance between Sections

Both the ends of a sample fiber are cross-sectionally cut so that the length in the direction of the fiber axis is 2.0 cm, and Ag Dotite (electroconductive resin paint containing silver particles; supplied by Fujikura Kogyo) is applied to the cross sections of the fiber. On an electrically insulating polyethylene terephthalate film, a direct current voltage of 1 KV is applied to the fiber by using the Ag Dotite-applied surfaces at a temperature of 20° C. and a relative humidity of 30%. A current flowing between both the sections is measured, and the electric resistance Ω/cm is calculated according to Ohm's law.

Surface Electric Resistance

The above-mentioned Ag Dotite is applied to the surface (side face of the fiber) of a sample fiber cut in a length of about 2.0 cm in the direction of the fiber axis in the vicinity of both the cut ends, and on an electrically insulating polyethylene terephthalate film, a direct current voltage of 1 KV is applied between the Ag Dotite-applied parts at a temperature of 20° C. and a relative humidity of 30%. An electric current flowing between the Ag Dotite-applied parts is measured and the distance between the Ag Dotite-applied parts is measured, and the surface electric resistance Ω/cm is calculated according to Ohm's law.

Number of Discharge Marks

The number of discharge marks having a diameter smaller than 2 microns, which are present on the entire surface over a length of 1 mm in the direction of the fiber axis, is counted.

Antistatic Property

A fabric is cut into a size of 4 cm (length)×8 cm (width) and a long cotton broadcloth (30/−) having a size of 2.5 cm (width)×14 cm (length) is used as a rubbing fabric. In a rotary drum type frictional charge quantity maasuring device (Kyodai Kaken-type rotary static tester), the friction test is carried out in an atmosphere maintained at a temperature of 20° C. and a relative humidity of 40% at a drum rotation number of 700 rpm and a contact pressure load of 600 g for a charging equilibrium time of 1 minute. The value of the frictional voltage is read in the unit of volt (V). The smaller is the value, the better is the antistatic property.

The present invention will now be described in detail with reference to the following examples that by no means limit the scope of the invention.

EXAMPLE 1

A kneader was charged with 240 parts by weight of an electroconductive powder having an average particle size of 0.25 μm and a specific resistivity of 9 Ω-cm, which was obtained by coating electroconductive stannic oxide on the surfaces of fine particles of titanium oxide, and 75 parts by weight of polyethylene having a melt index of 75, and the mixture was kneaded at 180° C. for 30 minutes. Then, 18 parts by weight of liquid paraffin and 4 parts by weight of stearic acid as an oleophilic agent were further added and the mixture was kneaded for 5 hours. The specific resistivity of the obtained electroconductive resin was $3.0\times10^2$ Ω-cm.

A core-sheath composite fiber (core/sheath ratio=1/6) was prepared by melt spinning using this electroconductive resin as the core and polyethylene terephthalate as the sheath, and the fiber was drawn at a draw ratio of 4 to obtain a 110-denier 12-filament multifilament yarn.

This core-sheath composite fiber was subjected to a corona discharge treatment at a voltage of −50 KV and a speed of 2 m/min. As shown in Table 2, the electroconductivity of the surface was improved by this corona discharge treatment and was substantially at the same level as the internal electric resistance between the sections.

TABLE 2

| | Surface Electric Resistance (Ω/cm) | Section Electric Resistance (Ω/cm) | Ratio |
|---|---|---|---|
| Starting fiber | $6\times10^{13}$ | $5\times10^{7}$ | $1.2\times10^{6}$ |
| Treated fiber | $7\times10^{7}$ | $4\times10^{7}$ | 1.7 |

EXAMPLE 2

In a kneader, 25 parts of electroconductive oil furnace black was kneaded with 75 parts by weight of polyethylene having a multi index of 12.0 at 160° C. for 2 hours to obtain chips of an electroconductive resin having a specific resistivity of 5×10 Ω-cm.

A core-sheath composite fiber (core/sheath ratio=1/6) was prepared by melt spinning using this electroconductive resin as the core and polyethylene terephthalate as the sheath, and the spun fiber was drawn at a draw ratio of 4 to obtain a 30-denier 3-filament multifilament yarn.

The core-sheath composite fiber was subjected to a discharge treatment under a voltage of +50 KV between high-voltage electrodes (the distance between the top of the needle electrode and the fiber surface was set at 20 mm).

On the surface of the core-sheath composite fiber obtained by this discharge treatment, as shown in FIG. 1, black points having a diameter smaller than 2 microns were observed as discharge marks.

Furthermore, by this discharge treatment, as shown in Table 3, the electroconductive of the surface was improved and was substantially at the same level as the internal electric resistance between the sections. When the treated fiber was formed into a circular knit and the frictional charge voltage was measured, it was found that the frictional charge voltage was 350 V and very good.

COMPARATIVE EXAMPLE 1

The electric resistance and strength-elongation characteristics of the core-sheath composite fiber of Example 2 before the discharge treatment are shown in Table 3.

EXAMPLE 3

A kneader was charged with 235 parts by weight of an electroconductive powder having an average particle size of 0.24 μm and a specific resistivity of 9.5 Ω-cm, which was obtained by coating electroconductive stannic oxide on the surfaces of fine particles of titanium oxide, and 75 parts by weight of polyethylene having a melt index of 76.8, and the mixture was kneaded at 180° C. for 40 minutes. Then, 18 parts by weight of liquid paraffin and 5 parts by weight of stearic acid as an oleophilic agent were further added and the mixture was kneaded for 6 hours. The specific resistivity of the obtained electroconductive resin was $4\times10^{12}$ Ω-cm.

A core-sheath composite fiber (core/sheath ratio=1/5) was prepared by melt spinning using the obtained electroconductive resin as the core and polyethylene terephthalate as the sheath, and the fiber was drawn at a draw ratio of 3.5 to obtain a 75-denier 36-filament multifilament yarn.

The core/sheath fiber was subjected to a discharge treatment under a voltage of −45 KV at a speed of 150 m/min (the distance between the top of the needle electrode and the surface of the fiber was set at 10 mm) to obtain an electroconductive composite fiber. The electroconductivity and reduction of the strength are shown in Table 3.

COMPARATIVE EXAMPLE 2

The electric resistance and elongation-strength characteristics of the fiber of Example 3 before the discharge treatment are shown in Table 3.

COMPARATIVE EXAMPLE 3

The core-sheath composite fiber used in Example 2 was subjected to the discharge treatment under the same conditions as described in Example 2 except that the top of the needle electrode and the surface of the fiber was set at 2 mm to increase the discharge intensity.

Degradation of the strength was extreme in the obtained yarn, and weaving was impossible.

TABLE 3

| Run No. | Number of Discharge Marks | Surface Electric Resistance (Ω/cm) | Electric Resistance between Sections (Ω/cm) | Ratio | Antistatic Property (V) | Strength (g/d) | Elongation (%) | Remarks |
|---|---|---|---|---|---|---|---|---|
| 1 | 36 | $2 \times 10^6$ | $6 \times 10^5$ | 3.3 | 350 | 3.0 | 40.1 | Example 2 |
| 2 | 0 | $4 \times 10^{14}$ | $4 \times 10^5$ | $1 \times 10^9$ | 1800 | 3.2 | 42.5 | Comparative Example 1 |
| 3 | 22 | $5 \times 10^8$ | $1 \times 10^7$ | $5 \times 10$ | 400 | 2.9 | 39.7 | Example 3 |
| 4 | 0 | $6 \times 10^{13}$ | $3 \times 10^7$ | $2 \times 10^6$ | 2200 | 3.1 | 42.3 | Comparative Example 2 |
| 5 | fused discharge marks | $2 \times 10^{14}$ | $3 \times 10^{12}$ | $6.7 \times 10$ | | 0.5 | 15 | Comparative Example 3 |

EXAMPLE 4

30 parts by weight of electroconductive carbon black was kneaded with 70 parts by weight of low melting temperature nylon at 180° C. for 2 hours in a kneader to obtain electroconductive chips of a specific resistivity of $5 \times 10$ Ω-cm.

A core-sheath composite fiber (core/sheath ratio = 1/5) was prepared by melt spinning using this electroconductive resin as the core and polyethylene terephthalate as the sheath, and the fiber was drawn at a draw ratio of 4 to obtain a 30 denier-5 filament multifilament yarn.

The core-sheath composite fiber was dipped into an aqueous 5% potassium sulfate solution, squeezed to a pick-up of 70%, and then subjected to a discharge treatment at a high voltage of −20 KV and a speed of 10 m/min, and at a distance of 1 mm between the fiber surface and the electrode tip.

The obtained fiber had 1 or more discharge marks per mm of the length in the fiber axis direction and improved degree of distribution of the discharge marks. The fiber had a surface electric resistance of $9 \times 10^6$ Ω/cm and an internal electric resistance between sections of $5 \times 10^6$ Ω/cm.

We claim:

1. An electroconductive core-sheath composite fiber comprising a core comprising a low temperature flowing polymeric material containing an electroconductive substance and a sheath formed of a fiber-forming polymer, which surrounds the core, wherein the core is completely covered with the sheath, the electric resistance of the surface of the fiber is lower than $10^{10}$ Ω/cm, and the ratio of the electric resistance (Ω/cm) of the surface to the internal electric resistance between the sections is lower than $10^3$ and wherein discharge marks having a diameter smaller than 2 microns, which are formed by a high-voltage discharge treatment, are scattered along the direction of the axis of the fiber, and at least one discharge mark is present per 1 mm of the length in the direction of the fiber axis.

2. A composite fiber a set forth in claim 1, wherein the core of the composite fiber is covered with the sheath having a thickness of at least 3 μm as measured from the surface of the sheath.

3. A composite fiber as set forth in claim 1, wherein the fiber-forming polymer is composed mainly of polyethylene terephthalate.

4. A composite fiber as set forth in claim 1, wherein the fiber-forming polymer is composed mainly of an aliphatic polyamide.

5. A composite fiber as set forth in claim 1, wherein the fiber-forming polymer is composed mainly of an aromatic polyamide.

6. A composite fiber as set forth in claim 1, wherein the fiber-forming polymer is composed mainly of polyethylene.

7. A composite fiber as set forth in claim 1, wherein the electroconductive substance of the core is composed mainly of electroconductive carbon black.

8. A composite fiber as set forth in claim 1, wherein the electroconductive substance of the core is composed mainly of a metal.

9. A composite fiber as set forth in claim 1, wherein the electroconductive substance of the core is composed mainly of an electroconductive metal compound.

10. A composite fiber as set forth in claim 9, wherein the electroconductive substance of the core is composed mainly of an electroconductive metal nitride.

11. A composite fiber as set forth in claim 9, wherein the electroconductive substance of the core is composed mainly of an electroconductive metal halide.

12. A composite fiber as set forth in claim 9, wherein the electroconductive substance of the core is composed mainly of an electroconductive metal sulfide.

13. A composite fiber as set forth in claim 9, wherein the electroconductive substance is a mixture of an electroconductive metal oxide and a metal oxide different from said electroconductive metal oxide.

14. A composite fiber as set forth in claim 1, wherein the electroconductive substance of the core is composed mainly of an electroconductive non-metallic compound.

15. A composite fiber as set forth in claim 14, wherein the electroconductive substance of the core is composed mainly of an electroconductive boride.

16. A composite fiber as set forth in claim 1, wherein the electroconductive substance of the core is a composite or mixture comprising at least two members selected from the group consisting of a carbon black, a metal, an electroconductive metal compound, and an electroconductive non-metallic compound.

* * * * *